US012383061B2

(12) United States Patent
Huang

(10) Patent No.: US 12,383,061 B2
(45) Date of Patent: Aug. 12, 2025

(54) PLASTIC DRAWER

(71) Applicant: Fujian Kangjia Furniture Co., Ltd., Quanzhou (CN)

(72) Inventor: Fusheng Huang, Nan'an (CN)

(73) Assignee: Fujian Kangjia Furniture Co., Ltd., Quanzhou (CN)

( * ) Notice: Subject to any disclaimer, the term of this patent is extended or adjusted under 35 U.S.C. 154(b) by 58 days.

(21) Appl. No.: 18/242,138

(22) Filed: Sep. 5, 2023

(65) Prior Publication Data

US 2025/0072606 A1 Mar. 6, 2025

(51) Int. Cl.
*A47B 88/90* (2017.01)

(52) U.S. Cl.
CPC ..... *A47B 88/941* (2017.01); *A47B 2210/092* (2013.01)

(58) Field of Classification Search
CPC ..... A47B 88/90; A47B 88/931; A47B 88/941; A47B 2088/902
USPC ..... 312/348.2
See application file for complete search history.

(56) References Cited

U.S. PATENT DOCUMENTS 4,171,150 A * 10/1979 Soderlund ..... A47B 96/00 312/265.5
4,934,531 A * 6/1990 Chen ..... G11B 23/0236 206/387.14
5,466,058 A * 11/1995 Chan ..... A47B 95/02 312/109
8,764,137 B2 * 7/2014 Fehre ..... A47B 88/975 312/348.2

* cited by examiner

*Primary Examiner* — James O Hansen

(57) ABSTRACT

Provided is a plastic drawer, relating to the technical field of drawers. The plastic drawer includes a base plate and a protective component, where for the base plate: left and right edge parts of an upper side are provided with two corresponding clamping slots, and uniformly distributed clamping columns are fixed inside the clamping slots; and for the protective component: the protective component includes side plates, first metal reinforcing ribs, a back plate and a second metal reinforcing rib, two corresponding side plates are arranged inside the two clamping slots that are arranged at the edge part of the upper side of the base plate, uniformly distributed fasteners are fixed to lower sides of both side plates, the clamping columns are clamped inside the fasteners, upper sides of the side plates are provided with fixed slots.

1 Claim, 4 Drawing Sheets

PLASTIC DRAWER

TECHNICAL FIELD

The present disclosure relates to the technical field of drawers, and in particular to a plastic drawer.

BACKGROUND

A drawer is a small box for putting things in a desk, a cabinet and other furniture. With a bottom and no cover, the drawer can be pulled out and pushed in, and a plastic drawer refers to a drawer made of plastics as raw materials.

The existing drawer is prone to deformation during use, and at the same time most of the existing plastic drawers are integrally formed. When one side of the plastic drawer deforms, disassembly cannot be preformed and the plastic drawer can only be scrapped, which is relatively wasteful, and therefore we propose a plastic drawer.

SUMMARY

The technical problem to be solved by the present disclosure is to overcome the existing defects and provide a plastic drawer, which has a higher strength, can be disassembled very conveniently at the same time, and may effectively solve the problem in the background art.

In order to achieve the above purpose, the present disclosure provides the technical solution below: a plastic drawer, including a base plate and a protective component;

for the base plate: left and right edge parts of an upper side are provided with two corresponding clamping slots, and uniformly distributed clamping columns are fixed inside the clamping slots; and for the protective component: the protective component includes side plates, first metal reinforcing ribs, a back plate and a second metal reinforcing rib, where two corresponding side plates are arranged inside the two clamping slots that are arranged at the edge part of the upper side of the base plate, uniformly distributed fasteners are fixed to lower sides of both side plates, the clamping columns are clamped inside the fasteners, upper sides of the side plates are provided with fixed slots, the first metal reinforcing ribs are fixed inside the fixed slots, the back plate is arranged between the two side plates, an upper side of the back plate is provided with a strip slot, in which the second metal reinforcing rib is fixed, the back plate and rear sides of the two side plates are mounted with two connecting components, and the whole strength can be effectively improved by setting the first metal reinforcing ribs and the second metal reinforcing rib.

Further, each connecting component includes T-shaped clamping blocks, clamping frames, clamping heads and disassembling plates, where two corresponding T-shaped clamping blocks are fixed to left and right sides of the back plate, corresponding inner sides of the two side plates are provided with two corresponding connecting slots, the T-shaped clamping blocks are clamped inside the connecting slots, a side of the back plate is provided with a first groove while a rear side of the back plate is provided with two corresponding second grooves, the clamping beads are clamped inside all the first groove and the second grooves, the two adjacent clamping heads are connected through one clamping frame, the disassembling plates are fixed to sides of the clamping frames, and the back plate is connected to the two side plates through the connecting components.

Compared with the prior art, the beneficial effect of the present disclosure is that the plastic drawer has the following advantages:

1. The whole strength can be effectively improved by setting the first metal reinforcing ribs and the second metal reinforcing rib, in order to avoid deformation caused by long-term use; and
2. A user may disassemble the clamping frames by pressing the disassembling plates and setting the connecting components when a disassembly is required, and then the back plate and the two side plates can be disassembled very quickly.

Figure 1:
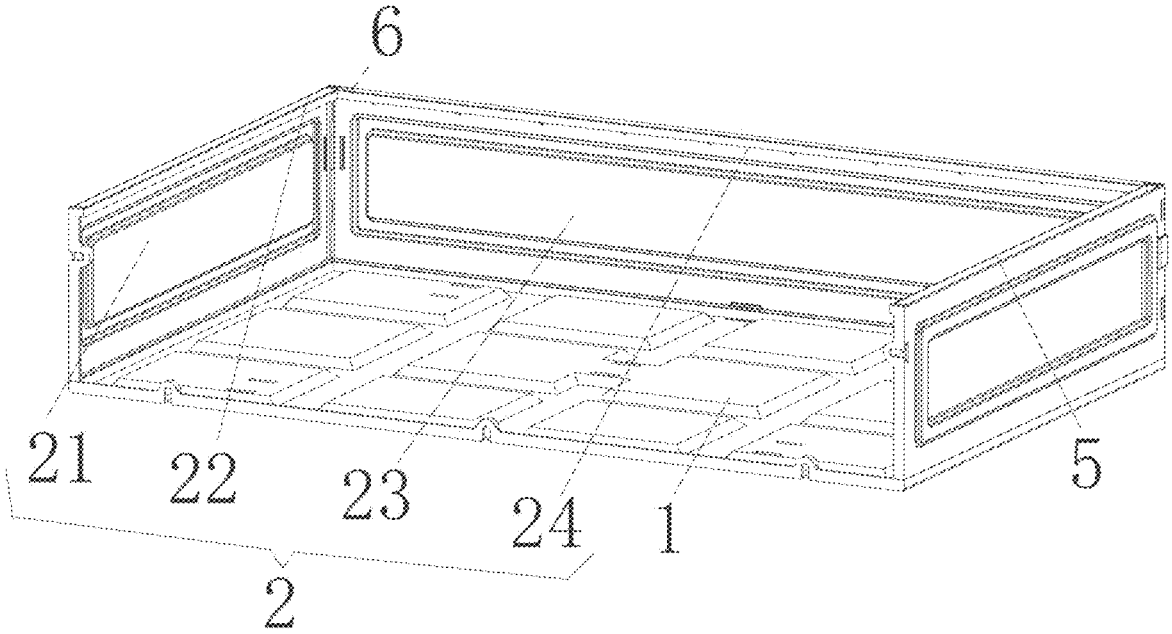
FIG. 1 is a schematic diagram of a front side of the present disclosure.

In the drawings: 1. Base plate, 2. Protective component, 21. Side plate, 22. First metal reinforcing rib, 23. Back plate, 24. Second metal reinforcing rib, 3. Connecting component, 31. T-shaped clamping block, 32. Clamping frame, 33. Clamping head, 34. Disassembling plate, 35. Connecting slot, 36. First groove, 37. Second groove, 4. Clamping column, 5. Fixed slot; 6. Strip slot, 7. Fastener, 8. Clamping slot.

DETAILED DESCRIPTION OF THE EMBODIMENTS

The technical solutions in the embodiments of the present disclosure are clearly and completely elaborated below in combination with the drawings. It is apparent that the described embodiments are only a part of the embodiments of the present disclosure but not all. Based on the embodiments of the present disclosure, all the other embodiments obtained by those of ordinary skill in the art on the premise of not contributing creative effort should belong to the protection scope of the present disclosure.

Figure 2:
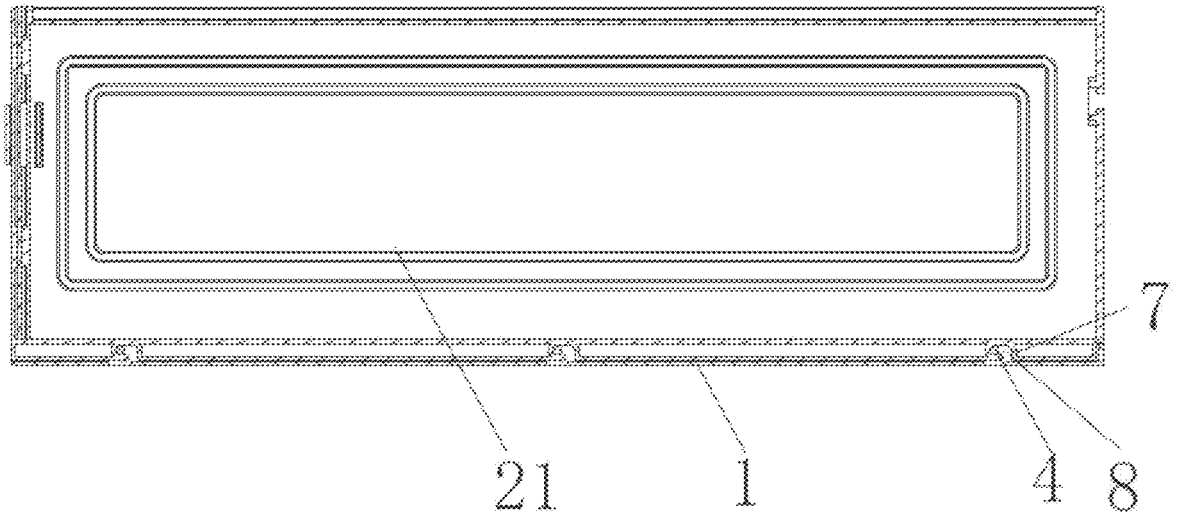
FIG. 2 is a section view of a right side of the present disclosure.
Figure 3:
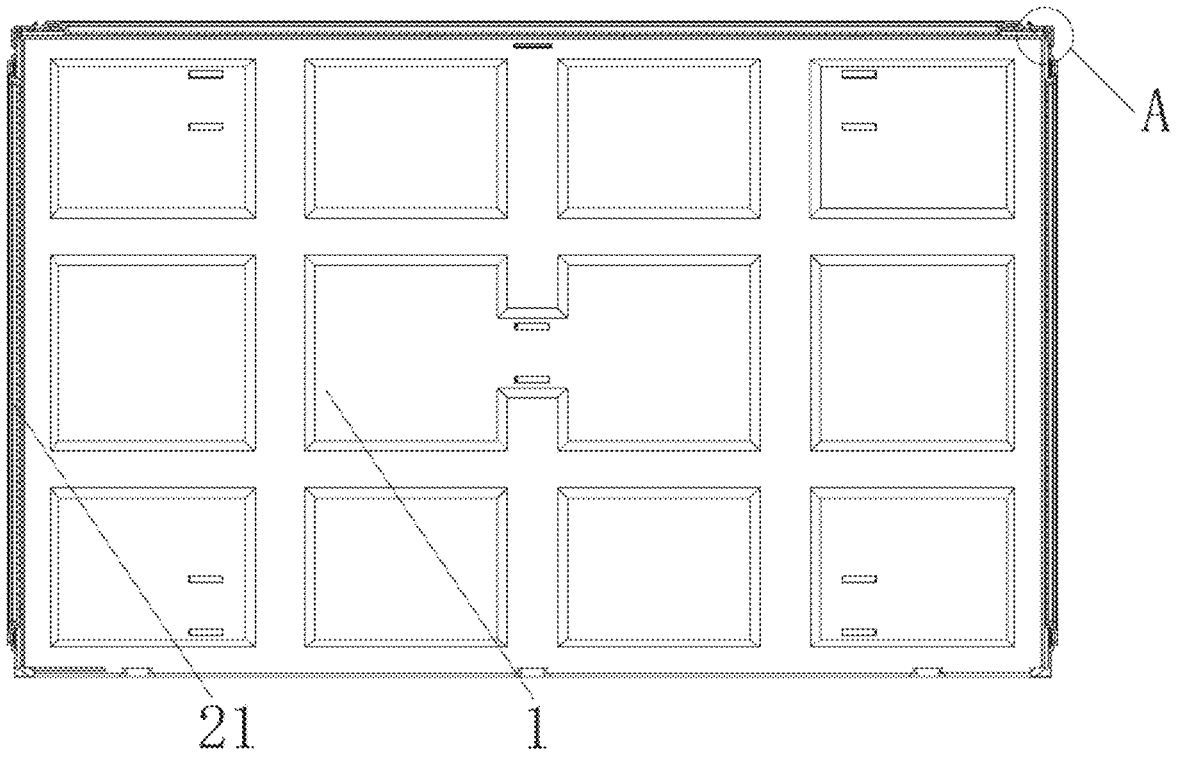
FIG. 3 is a section view of an upper side of the present disclosure.
Figure 4:
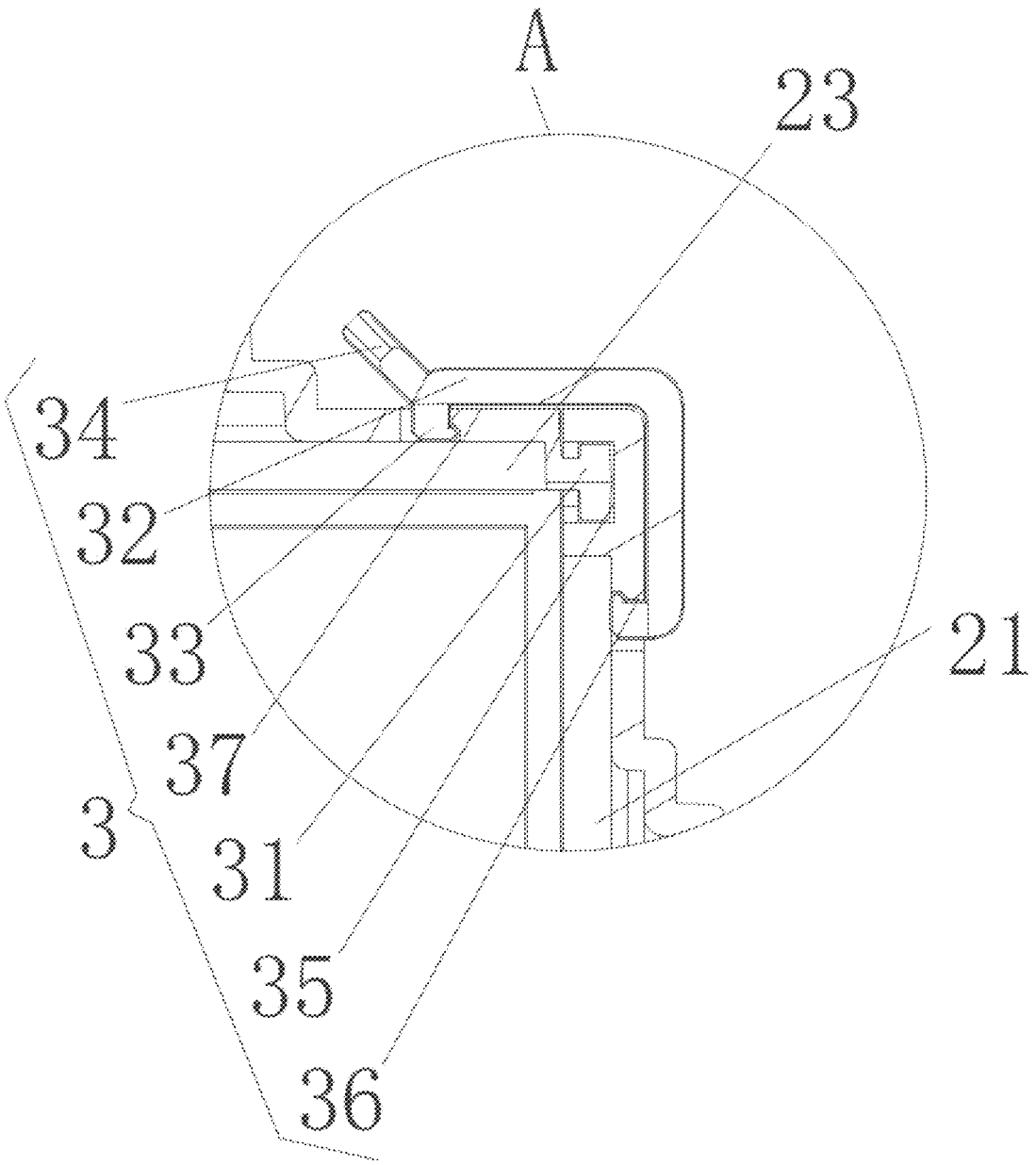
FIG. 4 is an enlarged diagram of a part A of the present disclosure.

Please refer to FIGS. 1 to 4, this embodiment provides a technical solution: a plastic drawer, including a base plate 1 and a protective component 2;

for the base plate 1: left and right edge parts of an upper side are provided with two corresponding clamping slots 8, and uniformly distributed clamping columns 4 are fixed inside the clamping slots 8;

for the protective component 2: the protective component 2 includes side plates 21, first metal reinforcing ribs 22, a back plate 23 and a second metal reinforcing rib 24, where two corresponding side plates 21 are arranged inside the two clamping slots 8 that are arranged at the edge part of the upper side of the base plate 1, uniformly distributed fasteners 7 are fixed to lower sides of both side plates 21, the clamping columns 4 are clamped inside the fasteners 7, upper sides of the side plates 21 are provided with fixed slots 5, the first metal reinforcing ribs 22 are fixed inside the fixed slots S, the back plate 23 is arranged between the two side plates 21, an upper side of the back plate 23 is provided with a strip slot 6, in which the second metal reinforcing rib 24 is fixed, the back plate 23 and rear sides of the two side plates 21 are mounted with two connecting components 3. Each connecting component 3 includes T-shaped clamping blocks 31, clamping frames 32, clamping heads 33 and disassembling plates 34, where two corresponding T-shaped clamping blocks 31 are fixed to left and right sides of the back plate 23, corresponding inner sides of the two side plates 21 are provided with two corresponding connecting slots 35, the T-shaped clamping blocks 31 are clamped inside the connecting slots 35, a side of the back plate 23 is provided with a first groove 36 while a rear side of the back plate 23 is provided with two corresponding second grooves 37, the clamping heads 33 are clamped inside all the first groove 36 and the second grooves 37, the two adjacent clamping heads 33 are connected through one clamping frame 32, the disassembling plates 34 are fixed to sides of the clamping frames 32, and the back plate 23 is connected to the two side plates 21 through the connecting components 3, and the whole strength can be effectively improved by setting the first metal reinforcing ribs 22 and the second metal reinforcing rib 24.

The working principle of the plastic drawer provided by the present disclosure is as follows: the first metal reinforcing ribs 22 and the second metal reinforcing rib 24 can effectively improve the whole strength during normal use, in order to avoid the deformation caused by long-term use. The user may disassemble the clamping frames 32 by pressing the disassembling plates 34 when a disassembly is required, the back plate 23 is drawn out after the clamping frames 32 are disassembled, and then the two side plates 21 are pulled onwards to make the fasteners 7 set at the lower sides thereof separate from the clamping columns 4, the two side plates 21 are drawn out after separation, and in such a case, the disassembly may be completed very quickly.

The above is only the embodiment of the present disclosure, instead of limiting the patent scope of the present disclosure. The equal structural or process transformations made according to the contents of the specification and the drawings of the present disclosure or direct or indirect application in other related technical fields fall within the protection scope of the present disclosure.

What is claimed is:

1. A plastic drawer, comprising a base plate and a protective component;

wherein left and right edge parts of an upper side of the base plate are provided with two clamping slots, and uniformly distributed clamping columns are fixed inside the two clamping slots;

wherein the protective component comprises side plates, first metal reinforcing ribs, a back plate and a second metal reinforcing rib, the side plates are arranged inside the two clamping slots that are arranged at the edge parts of the upper side of the base plate, uniformly distributed fasteners are fixed to lower sides of the side plates, upper sides of the side plates are provided with fixed slots, the first metal reinforcing ribs are fixed inside the fixed slots, the back plate is arranged between the side plates, an upper side of the back plate is provided with a strip slot, in which the second metal reinforcing rib is fixed, the back plate and rear sides of the side plates are mounted with two connecting components;

wherein each connecting component comprises T-shaped clamping blocks, clamping frames, clamping heads and disassembling plates; two corresponding T-shaped clamping blocks are fixed to left and right sides of the back plate; corresponding inner sides of the side plates are provided with two corresponding connecting slots; the T-shaped clamping blocks are clamped inside the connecting slots; a side of the back plate is provided with a first groove and a rear side of the back plate is provided with two corresponding second grooves, the clamping heads are clamped inside all the first groove and the second grooves, the two adjacent clamping heads are connected through one clamping frame, and the disassembling plates are fixed to sides of the clamping frames.

* * * * *